US007731344B2

(12) United States Patent
Iwamuro et al.

(10) Patent No.: US 7,731,344 B2
(45) Date of Patent: Jun. 8, 2010

(54) METHOD OF MANUFACTURING A LIQUID VESSEL

(75) Inventors: Takeshi Iwamuro, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 334 days.

(21) Appl. No.: 11/835,375

(22) Filed: Aug. 7, 2007

(65) Prior Publication Data

US 2008/0034584 A1 Feb. 14, 2008

(30) Foreign Application Priority Data

Aug. 8, 2006 (JP) ..... 2006-216112

(51) Int. Cl.

| | |
|---|---|
| ***B41J 2/195*** | (2006.01) |
| ***B41J 29/393*** | (2006.01) |
| ***B41J 2/17*** | (2006.01) |
| ***B41J 2/175*** | (2006.01) |
| ***B41J 2/19*** | (2006.01) |

(52) U.S. Cl. ..... 347/86; 347/7; 347/19; 347/84; 347/85; 347/92

(58) Field of Classification Search ..... 347/5, 347/7, 19, 84, 85, 86, 92
See application file for complete search history.

(56) References Cited

U.S. PATENT DOCUMENTS

| | | | | |
|---|---|---|---|---|
| 5,136,309 | A * | 8/1992 | Iida et al. | 347/7 |
| 5,315,317 | A * | 5/1994 | Terasawa et al. | 347/7 |
| 5,489,925 | A * | 2/1996 | Brooks et al. | 347/6 |
| 6,745,626 | B2 * | 6/2004 | Usui et al. | 73/290 R |
| 7,156,506 | B2 | 1/2007 | Tsukada et al. | |
| 7,195,330 | B2 * | 3/2007 | Seino et al. | 347/19 |
| 2002/0105555 | A1 * | 8/2002 | Tsukada et al. | 347/7 |
| 2003/0117450 | A1 | 6/2003 | Usui et al. | |
| 2006/0137447 | A1 | 6/2006 | Usui et al. | |
| 2007/0103493 | A1 | 5/2007 | Tsukada et al. | |
| 2008/0034584 | A1 | 2/2008 | Iwamuro et al. | |

FOREIGN PATENT DOCUMENTS

| | | | |
|---|---|---|---|
| DE | 3344447 | A1 * | 6/1984 |
| EP | 1 164 021 | A2 | 12/2001 |
| JP | 62259860 | A * | 11/1987 |
| JP | 2002036596 | A * | 2/2002 |

(Continued)

*Primary Examiner*—Stephen D Meier
*Assistant Examiner*—Leonard S Liang
(74) *Attorney, Agent, or Firm*—Sughrue Mion, PLLC

(57) ABSTRACT

Disclosed herein is a method of manufacturing a liquid vessel including a liquid containing body having a discharge port for discharging liquid, and a liquid residual amount detection device having a liquid inflow port connected to the discharge port, a liquid lead-out portion for supplying the liquid and a vibration detection portion for applying vibration to a flow path between the liquid inflow port and the liquid lead-out portion and detecting a residual amount of liquid in the liquid containing body, the method including: connecting the liquid inflow port of the liquid residual amount detection device to the discharge port of the liquid containing body in which the liquid has been stored in advance and injecting the liquid from the liquid containing body into the liquid residual amount detection device to obtain a state in which the flow path is charged with the liquid.

11 Claims, 8 Drawing Sheets

FOREIGN PATENT DOCUMENTS

| | | | | |
|---|---|---|---|---|
| JP | 2004136670 | A | * | 5/2004 |
| JP | 2005096469 | A1 | | 4/2005 |
| JP | 2006-160371 | A | | 6/2006 |
| JP | 2008-037016 | A | | 2/2008 |
| WO | 2006/052034 | A1 | | 5/2006 |

* cited by examiner

METHOD OF MANUFACTURING A LIQUID VESSEL

CROSS REFERENCE TO RELATED APPLICATIONS

This application is based on Japanese Patent Application No. 2006-216112, filed Aug. 8, 2006, the entire disclosure of which is expressly incorporated by reference herein.

BACKGROUND OF THE INVENTION

1. Technical Field

The present invention relates to a method of manufacturing a liquid vessel for supplying a predetermined liquid to a liquid consuming apparatus such as a liquid ejecting head for discharging a small amount of liquid drops.

2. Related Art

A liquid ejecting head of a commercial recording apparatus requiring ultra-high quality printing, such as a printing apparatus or a micro dispenser, receives liquid discharged from a liquid vessel. However, when the liquid ejecting head operates in a state in which the liquid is not supplied, a so-called idle operation is performed and the liquid ejecting head may be damaged. Accordingly, in order to prevent this kind of damage, a residual amount of liquid in the vessel should always be monitored.

Accordingly, a variety of recording apparatuses have been suggested in which a device for detecting a residual amount of ink is included in a liquid vessel such as an ink cartridge. One example of an ink cartridge including a liquid residual amount detection device comprises an ink cartridge including a liquid containing body for discharging stored liquid through a discharge port and the liquid residual amount detection device by pressurization, where the liquid residual amount detection device is connected to the liquid containing body. Here, the liquid residual amount detection device includes a piezoelectric element for applying vibration to a flow path whose one end is connected to the discharge port of the liquid containing body and whose other end is connected to the liquid lead-out portion for supplying liquid to the outside. A residual amount of liquid in the liquid containing body is detected by detecting a variation in acoustic impedance when the vibration is applied by the piezoelectric element.

However, even in the ink cartridge including a liquid residual amount detection device, if air bubbles remain in the liquid containing body or the flow path of the liquid residual amount detection device when the ink cartridge is mounted in a recording apparatus, the remaining air bubbles are supplied to the recording apparatus, thus causing a problem such as an idle operation of a recording head.

Accordingly, when such an ink cartridge is manufactured, an advanced charging technology for charging ink such that air bubbles do not remain in the liquid containing body or the flow path in the liquid residual amount detection device is needed.

Under such circumstances, as a method of charging the ink into the ink cartridge, the liquid residual amount detection device is connected to an empty liquid containing body in advance, an external suction device is connected to the liquid lead-out portion, and deaeration is performed with respect to the liquid residual amount detection device and the liquid containing body by negative pressure suction with the suction device. Thereafter, instead of the suction device, a method was suggested of connecting an ink supply path from the ink charging portion to the liquid lead-out portion and pressurizing and charging the ink into the liquid residual amount detection device and the liquid containing body (see, for example, JP-A-2005-96469).

However, in the method of charging the ink into the ink cartridge, equipment is required for rapidly connecting and switching the suction device for performing deaeration with respect to the empty liquid residual amount detection device and the liquid containing body through the liquid lead-out portion, while a deaeration state is maintained by the suction device. Thus, equipment necessary for charging the ink becomes complicated or equipment cost is increased.

A deaeration degree of the suction device is apt to be uneven due to flexibility of the liquid containing body or the structure of the flow path of the liquid residual amount detection device. When the connection to the liquid lead-out portion is switched from the suction device to the ink charging device, the deaeration degree may be reduced, although a variation thereof is small. Accordingly, it is difficult to stably produce a product having a predetermined deaeration degree.

When a load due to a suction negative pressure is applied to a sensor in the liquid residual amount detection device for a long time, such as during the deaeration process either before charging the ink or before applying a positive pressure at the time of charging the ink, the sensor in the liquid residual amount detection device may be damaged.

SUMMARY

An advantage of some aspects of the invention is that it provides a method of manufacturing a liquid vessel; the method being capable of stably producing a high-quality liquid vessel in which liquid is charged with a predetermined deaeration degree, simplifying equipment for charging the liquid in the liquid vessel, reducing equipment cost, and preventing a sensor in a liquid residual amount detection device from being damaged by an operation of charging the liquid.

According to an aspect of the invention, there is provided a method of manufacturing a liquid vessel including a liquid containing body having a discharge port for discharging liquid; a liquid residual amount detection device having a liquid inflow port connected with the discharge port; a liquid lead-out portion for supplying the liquid; and a vibration detection portion for applying vibration to a flow path between the liquid inflow port and the liquid lead-out portion, and detecting a residual amount of liquid in the liquid containing body; the method including: connecting the liquid inflow port of the liquid residual amount detection device to the discharge port of the liquid containing body in which the liquid has been stored in advance; and injecting the liquid in the liquid containing body into the liquid residual amount detection device to obtain a state in which the flow path is charged with the liquid.

By this configuration, the discharge of gas remaining in the flow path of the liquid residual amount detection device or the charging of the liquid in the flow path are realized by injecting the liquid charged into the liquid containing body into the liquid residual amount detection device in advance. Since the liquid injected from the liquid containing body into the liquid residual amount detection device extrudes gas or air bubbles remaining in the liquid residual amount detection device through the liquid lead-out portion, the liquid can be charged into the liquid residual amount detection device with a uniform deaeration degree, although deaeration of the liquid residual amount detection device is not performed by negative pressure suction in advance.

The liquid containing body may be pressurized by a pressurizing device such that the liquid in the liquid containing body is injected into the liquid residual amount detection device.

With this configuration, it is possible to easily inject the liquid in the liquid containing body into the liquid residual amount detection device by pressurizing the liquid containing body.

The liquid in the liquid containing body may be injected into the liquid residual amount detection device by suction of a suction device connected to the liquid lead-out portion.

With this configuration, when the liquid in the liquid containing body is injected into the liquid residual amount detection device, gas in the liquid residual amount detection device can be efficiently discharged by the suction force applied to the liquid residual amount detection device, and thus the liquid can be more stably charged with a high deaeration degree.

The method may further include decompressing the flow path of the liquid residual amount detection device before the liquid in the liquid containing body is injected into the liquid residual amount detection device.

With this configuration, the liquid in the liquid containing body is easily injected into the liquid residual amount detection device by the pressure difference between the liquid containing body and the liquid residual amount detection device. Accordingly, a charging time can be reduced and thus the productivity can be improved.

The method may further include injecting the liquid from the liquid containing body into the liquid residual amount detection device, decompressing the liquid residual amount detection device into which the liquid is injected, and injecting the liquid in the liquid containing body into the decompressed liquid residual amount detection device again.

With this configuration, small air bubbles remaining in the liquid residual amount detection device after the injecting of the liquid expand by the decompressing of the liquid residual amount detection device and grow to large air bubbles which can be easily discharged. The large air bubbles can be discharged from the liquid lead-out portion to the outside of the liquid residual amount detection device by the injecting of the liquid again, such that a higher deaeration degree can be obtained.

The decompressing of the liquid residual amount detection device may be performed by applying a negative pressure from the liquid lead-out portion to the liquid residual amount detection device when a flow path opening/closing device provided in the vicinity of the liquid inflow port of the liquid residual amount detection device is closed.

With this configuration, since it is possible to efficiently decompress the flow path of the liquid residual amount detection device with certainty, it is possible to easily apply a valid pressure difference to the injection of the liquid from the liquid containing body to the liquid residual amount detection device.

The injecting of the liquid in the liquid containing body into the decompressed liquid residual amount detection device again may be performed by applying a negative pressure from the liquid lead-out portion to the liquid residual amount detection device when a flow path opening/closing device provided in the vicinity of the liquid inflow port of the liquid residual amount detection device is opened.

With this configuration, the liquid injected from the liquid containing body into the liquid residual amount detection device through the flow path opening/closing device can be actively injected by the suction force according to the negative pressure applied to the liquid residual amount detection device, and external air is prevented from being mixed into the liquid residual amount detection device. Thus, it is possible to charge the ink in a stable deaeration state.

The liquid in the liquid containing body may be charged into the liquid residual amount detection device and then discharged from the liquid lead-out portion until the amount of liquid stored in the liquid containing body is a predetermined amount.

With this configuration, since the amount of liquid remaining in the liquid vessel can be accurately set, it is possible to stably produce a reliable liquid vessel with a uniform ink storage amount.

The liquid may be ink supplied to an inkjet recording apparatus, and the ink in the liquid containing body may be injected into the liquid residual amount detection device when a temperature of the ink in the liquid containing body is increased to a predetermined temperature.

With this configuration, since the viscosity of the ink in the liquid containing body is reduced by increasing the temperature of the ink, the ink is easily injected from the liquid containing body into the liquid residual amount detection device. The negative pressure applied to the liquid residual amount detection device can then be reduced, and the burden on the sensor of the liquid residual amount detection device can also be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, methods of manufacturing liquid vessels according to embodiments of the invention will be described in detail, with reference to the accompanying drawings.

Figure 1:
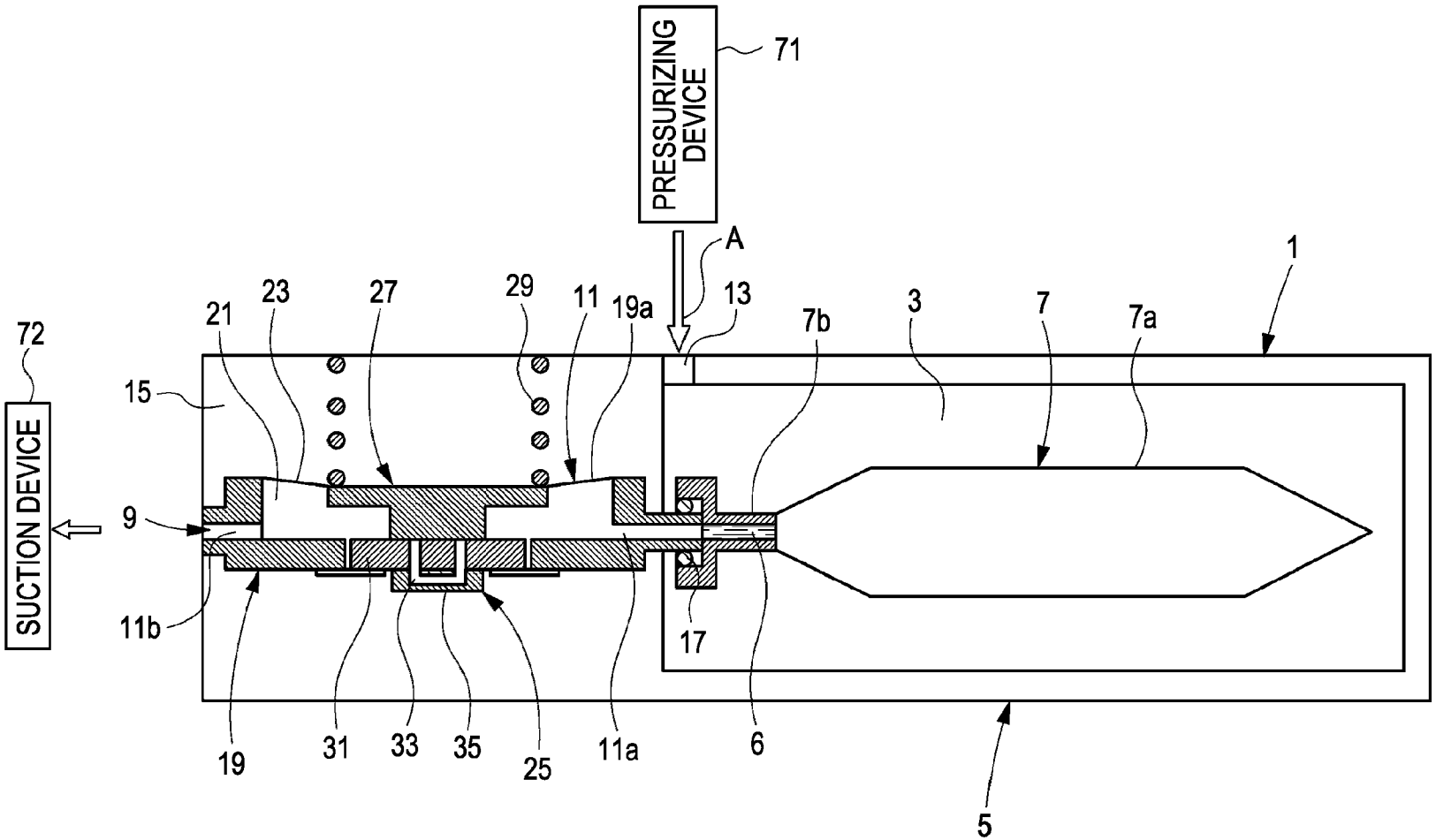
FIG. 1 is a vertical cross-sectional view showing a state before ink is charged into an ink cartridge as a liquid vessel according to a first embodiment of the invention.
Figure 2:
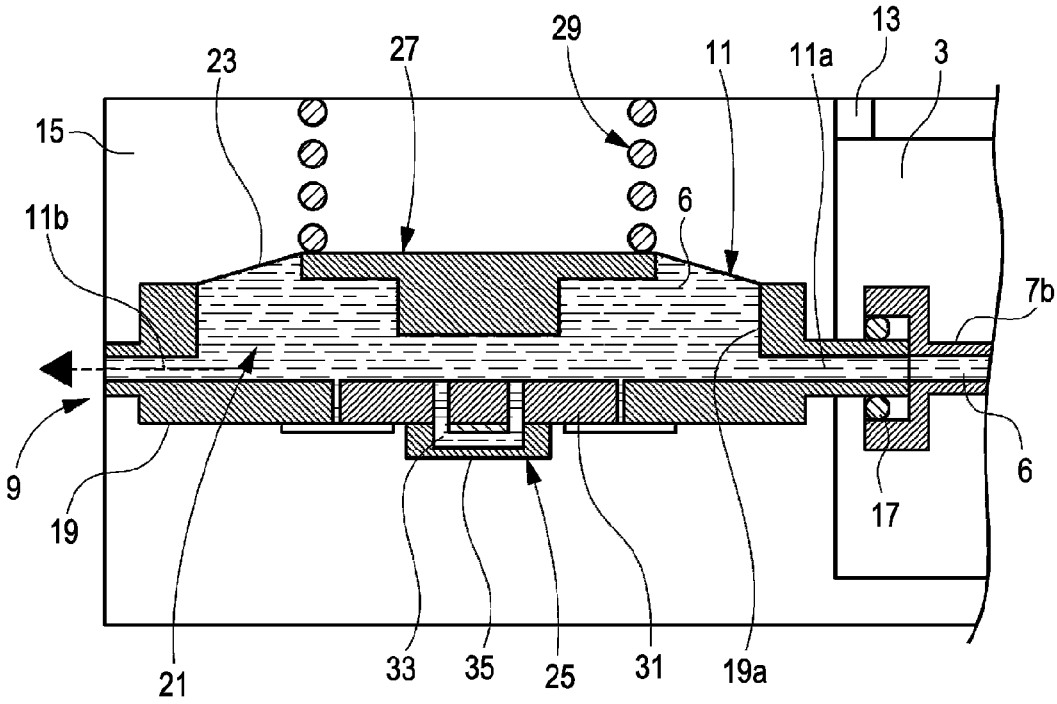
FIG. 2 is a vertical cross-sectional view showing a state in which ink is charged into the ink cartridge as the liquid vessel according to the first embodiment of the invention.
Figure 3:
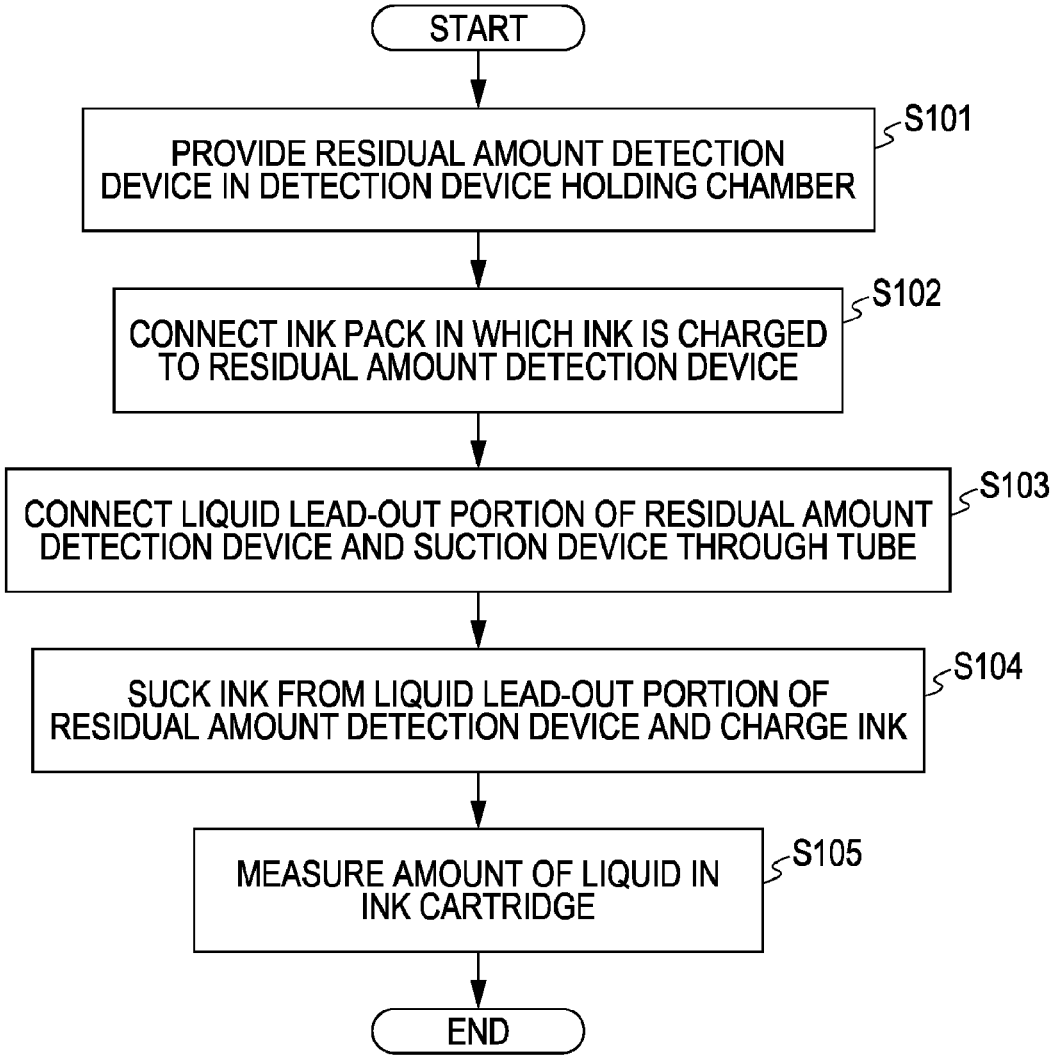
FIG. 3 is a flowchart showing a method of manufacturing the liquid vessel according to the first embodiment of the invention.
Figure 4:
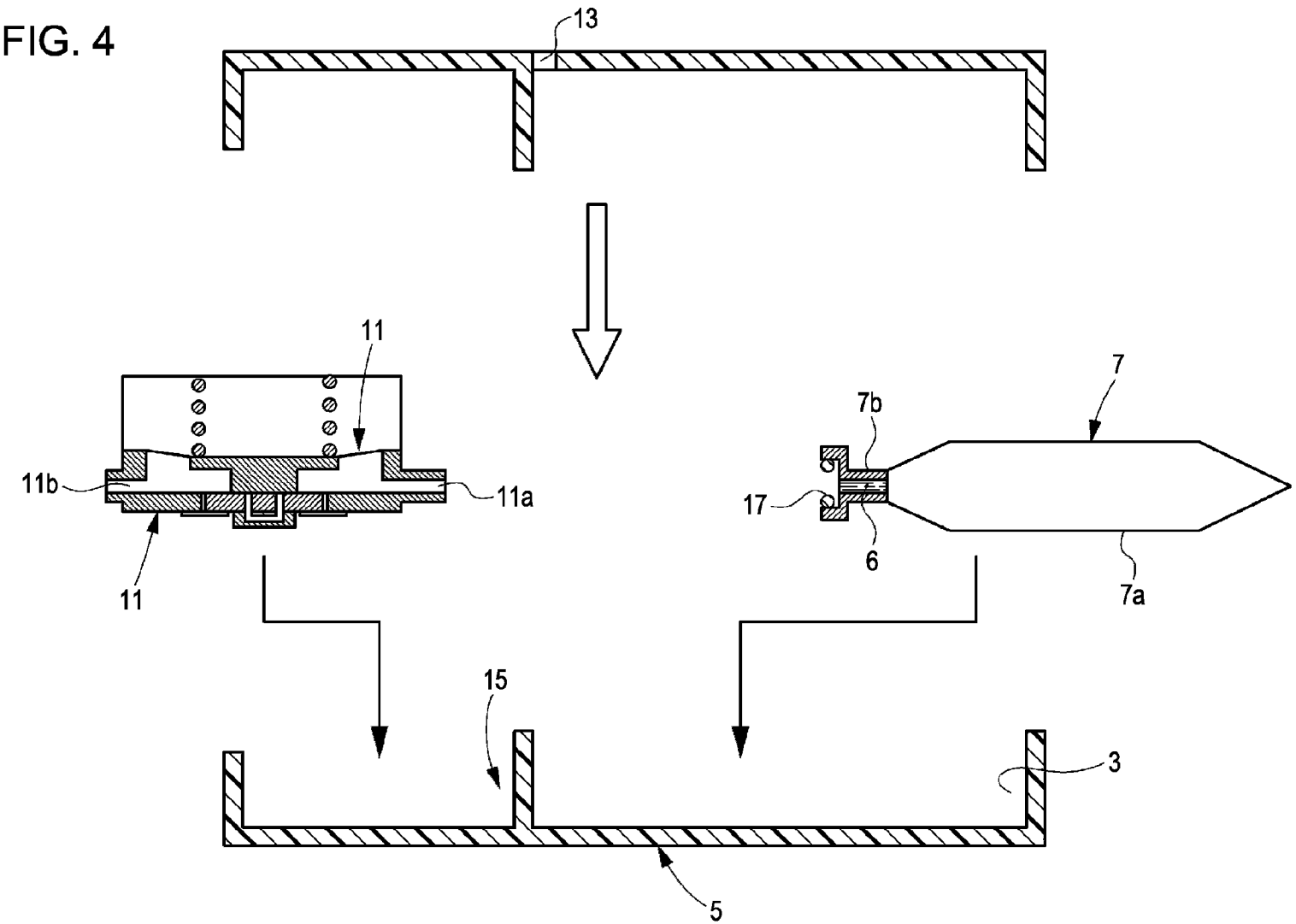
FIG. 4 is an exploded view of a state before the ink cartridge is configured as the liquid vessel according to the first embodiment of the invention.

FIG. 1 is a vertical cross-sectional view showing a state before ink is charged into an ink cartridge as a liquid vessel according to a first embodiment of the invention. FIG. 2 is a vertical cross-sectional view showing a state in which ink has been charged into the ink cartridge as the liquid vessel according to the first embodiment of the invention. FIG. 3 is a flowchart showing a method of manufacturing the liquid vessel according to the first embodiment of the invention. FIG. 4 is an exploded view depicting a state before the ink cartridge is configured as the liquid vessel according to the first embodiment of the invention.

First, the configuration of an ink cartridge into which ink as liquid is charged and manufactured by a manufacturing method according to the first embodiment of the invention will be described, with reference to FIGS. 1 and 2.

The ink cartridge 1 shown FIG. 1 is a liquid vessel which is detachably mounted in a cartridge mounting portion of an inkjet recording apparatus (not shown) and supplies ink to a recording head (liquid ejecting head) mounted in the recording apparatus.

The ink cartridge 1 includes a vessel body 5 in which a pressurization chamber 3 pressurized by a pressurizing device 71 is formed, a liquid containing body 7 functioning as an ink pack which stores the ink 6 and has a discharge port 7*b* for discharging the ink 6, a liquid inflow port 11*a* connected to the discharge port 7*b*, a liquid lead-out portion 9 for supplying the ink 6 to the outside, a liquid residual amount detection device 11 having a vibration detection portion 25 for applying vibration to a flow path between the liquid inflow port 11*a* and the liquid lead-out portion 9 and detecting a residual amount of ink in the liquid containing body 7.

The vessel body 5 is a casing formed of resin and includes the pressurization chamber 3 in a sealed state, a pressurization port 13 which is a passage for allowing the pressurizing device 71 to supply pressurization air to the pressurization chamber 3 as denoted by an arrow A, and a detection device holding chamber 15 for holding the liquid residual amount detection device 11. The detection device holding chamber 15 is blocked from the pressure of the pressurization air supplied to the pressurization chamber 3.

The liquid containing body 7 is the so-called ink pack obtained by adhering a tubular discharge port 7*b* connected with the liquid inflow port 11*a* of the liquid residual amount detection device 11 to one end of a sealing body 7*a* obtained by adhering circumferential edges of aluminum laminate multi-layered films obtained by laminating an aluminum layer on a resin film layer to each other. When the aluminum laminate multi-layered film is used, a high gas barrier property is obtained.

The liquid containing body 7 and the liquid residual amount detection device 11 are connected to each other by fitting the liquid inflow port 11*a* to the discharge port 7*b*. That is, the liquid containing body 7 and the liquid residual amount detection device 11 can be disconnected from each other by releasing the fitting between the discharge port 7*b* and the liquid inflow port 11*a*. In the fitting portion between the discharge port 7*b* and the liquid inflow port 11*a*, air-tightness is maintained by a sealing member (packing) 17.

Before the liquid containing body 7 is connected to the liquid residual amount detection device 11, the ink 6 previously adjusted to have a high deaeration state is charged into the liquid containing body 7.

The liquid residual amount detection device 11 includes a detection portion casing 19 having a concave space 19*a* for facilitating communication between the liquid inflow port 11*a* connected to the discharge port 7*b* of the liquid containing body 7 and a liquid outflow port 11*b* connected to the liquid lead-out portion 9, a flexible film 23 which is a partition wall for sealing an opening of the concave space 19*a* and partitioning a liquid detection chamber 21, a vibration detection portion 25 mounted on the bottom of the concave space 19*a*, a pressure reception plate 27 adhered to the flexible film 23 at a side opposite the vibration detection portion 25, a pressing spring 29 which is an energizing device pressed and mounted between the pressure reception plate 27 and the upper wall of the detection device reception chamber 15, for energizing the pressure reception plate 27 and the flexible film 23 in a direction for reducing the volume of the liquid detection chamber 21.

In the detection portion casing 19, the liquid inflow port 11*a* is integrally formed at one end of a circumferential wall for partitioning the concave space 19*a* and the liquid outflow 11*b* communicating with the liquid lead-out portion 9 penetrated through a circumferential wall at a side opposite the liquid inflow port 11*a*.

Although not shown, a valve (flow path opening/closing device) for opening a flow path is mounted in the liquid lead-out portion 9. The valve can be opened by inserting an ink supply needle mounted in the cartridge mounting portion when the ink cartridge 1 is mounted in the cartridge mounting portion of the inkjet recording apparatus.

The vibration detection portion 25 of the liquid residual amount detection device 11 includes a bottom plate 31, an ink guide path 33 which is a concave portion formed in the bottom plate 31, and a piezoelectric element 35 for applying vibration to the ink guide path 33 and detecting a free vibration state according to the applied vibration. The bottom plate 31 closely contacts the pressure reception plate 27 due to an energizing force of the pressing spring 29 when the ink 6 is not led out from the liquid containing body 7 to the liquid lead-out portion 9. The piezoelectric element 35 also detects the existence of the ink 6 from the free vibration state, which varies according to whether the ink guide path 33 is closed by the pressure reception plate 27 or whether air bubbles are mixed in.

The energizing direction of the pressing spring 29 is a direction for reducing the volume of the liquid detection chamber 21 and a direction in which the piezoelectric element 35 is arranged, as described above.

The ink guide path 33, which is the concave portion formed in the bottom plate 31, becomes a closed space blocked from the liquid detection chamber 21 in a state in which the pressure reception plate 27 is closely attached to the bottom plate 31, as shown in FIG. 1. The ink guide path 33 communicates with the liquid detection chamber 21 when the pressure reception plate 27 is separated from the bottom plate 31, as shown in FIG. 2.

In a state in which the ink cartridge 1 is inserted into the cartridge mounting portion of the recording apparatus (not shown), in the liquid residual amount detection device 11, the flexible film 23 is expanded and deformed upward in correspondence with a variation in an ink storage amount (liquid level); such as when the ink 6 is supplied from the liquid containing body 7 to the liquid detection chamber 21 by pressurizing the liquid containing body 7, as shown in FIG. 2. By the deformation of the flexible film 23, the pressure reception plate 27 forming a portion of the partition wall of the liquid detection chamber 21 is moved upward, and the pressure reception plate 27 is separated from the bottom plate 31. When the pressure reception plate 27 is separated from the bottom plate 31, the ink guide path 33 communicates with the liquid detection chamber 21 such that the ink 6 is supplied from the liquid lead-out portion 9 to the recording head through the liquid detection chamber 21.

Meanwhile, in the state in which the ink cartridge 1 is inserted into the cartridge mounting portion of the recording apparatus (not shown), when the amount of ink 6 contained in the liquid containing body 7 is reduced, even though the pressurization chamber 3 is in a defined pressurization state, the amount of ink supplied from the liquid containing body 7 to the liquid detection chamber 21 is reduced. When the ink storage amount of the liquid detection chamber 21 is reduced, the pressure reception plate 27 becomes close to the bottom plate 31 having the ink guide path 33.

In the ink cartridge 1 according to the present embodiment, at a point in time when the pressure reception plate 27 is closely attached to the bottom plate by the reduction of the ink storage amount of the liquid detection chamber 21, to allow the ink guide path 33 to become a closed space, the ink cartridge is set to a state in which the liquid in the liquid containing body 7 is used up.

The flexible film 23 functions as a diaphragm for applying displacement to the pressure reception plate 27 according to the pressure of the ink 6 supplied to the liquid detection chamber 21. In order to detect a small variation in pressure of the ink 6 to improve detection precision, the flexible film 23 should have sufficient flexibility.

Next, an ink charging method applied to the method of manufacturing the liquid vessel according to the first embodiment of the invention is disclosed. That is, an ink charging method for obtaining an initial charge state in the process of manufacturing the ink cartridge 1, will be described with reference to FIG. 3. In the ink charging method, the ink is charged into the liquid detection chamber 21; the liquid inflow port 11*a*; the liquid outflow port 11*b*; and the ink guide path 33; all of which are flow paths of the liquid residual amount detection device 11.

In the ink charging method according to the first embodiment, first, in a step S101, as shown in FIG. 4, the liquid residual amount detection device 11 is provided in the detection device holding chamber 15 of the vessel body 5. In the liquid residual amount detection device 11, the pressing spring 29 is integrally mounted in advance. Subsequently, in a step S102, the liquid containing body 7 into which the ink 6 is charged with a predetermined deaeration degree is provided in the pressurization chamber 3 of the vessel body 5. The liquid inflow port 11*a* of the liquid residual amount detection device 11 is connected to the discharge port 7*b* of the liquid containing body 7, and half bodies of the vessel body 5 are adhered together, obtaining an assembly state shown in FIG. 1.

Subsequently, in a step S103, as shown in FIG. 1, a suction device 72 is connected to the liquid lead-out portion 9 of the liquid residual amount detection device 11 through a connection tube (not shown). Subsequently, in a step S104, the pressurization air is supplied into the pressurization chamber 3 by the pressurizing device 71; suction is performed by the suction device 72; the ink 6 in the liquid containing body 7 is injected into the liquid residual amount detection device 11; and air remaining in the liquid inflow port 11*a*, the liquid detection chamber 21, the liquid outflow port 11*b*, and the ink guide path 33 (all of which are the flow paths from the discharge port 7*b* to the liquid lead-out portion 9), is eliminated, thereby obtaining the initial charge state in which the ink 6 is filled.

Subsequently, in a step S105, a total amount of residual ink in the ink cartridge is detected by measuring a total weight of the ink cartridge 1, such that a determination as to whether the amount of residual ink is in an allowable range of a product is made.

The manufacture of the ink cartridge 1 according to the first embodiment of the invention is completed.

In the above-described method of manufacturing the ink cartridge according to the first embodiment of the invention, the discharge of gas remaining in the liquid detection chamber 21, the liquid inflow port 11*a*, or the liquid outflow port 11*b*, all of which are the flow paths of the liquid residual amount detection device 11, and the charging of the ink 6 into the flow paths, are realized by injecting the ink 6 charged into the liquid containing body 7 into the liquid residual amount detection device 11 in advance. In this manufacturing method, since gas or air bubbles remaining in the liquid residual amount detection device 11 are extruded through the liquid lead-out portion 9 while the ink 6 is injected from the liquid containing body 7 to the liquid residual amount detection device 11, the ink 6 can be charged into the liquid residual amount detection device 11 with a predetermined deaeration degree, although deaeration is not performed in advance in the liquid residual amount detection device 11 by negative pressure suction. Accordingly, it is possible to stably produce the high-quality ink cartridge 1 into which the ink 6 is charged with the predetermined deaeration degree.

An operation for injecting the ink 6 from the liquid containing body 7 into the liquid residual amount detection device 11 can be easily realized by supplying pressurized air to the pressurization chamber 3 by the pressurizing device 71, and pressurizing the liquid containing body 7 in the pressurization chamber 3, as described in the above-described embodiment.

Accordingly, equipment for charging the ink 6 into the ink cartridge 1 can be simplified to reduce equipment cost, since equipment for switching the connection from the liquid supply path of the liquid charging device to the liquid lead-out portion 9 is unnecessary. This results because in the present embodiment, the ink 6 is injected from an external liquid charging device connected to the liquid lead-out portion 9 and into the liquid residual amount detection device 11. As a result, cost of the ink cartridge into which the ink 6 is charged can be reduced.

Compared with the case where the liquid is injected from the external liquid charging device connected to the liquid lead-out portion 9 and into the liquid residual amount detection device 11, suction for the deaeration process before charging the ink can be omitted, and a high positive pressure does not need to be applied at the time of charging the ink.

Although in the present embodiment, when the ink 6 in the liquid containing body 7 is initially charged into the liquid residual amount detection device 11, the liquid containing body 7 is pressurized by the pressurizing device 71 and the suction is performed by the suction device 72 connected to the liquid lead-out portion 9, the ink 6 may be injected from the liquid containing body 7 into the liquid residual amount detection device 11 by either pressurization of the pressurizing device 71 or the suction of the suction device 72.

However, when the pressurization of the pressurizing device 71 and the suction of the suction device 72 are simultaneously performed as in the present embodiment, the gas in the liquid residual amount detection device 11 can be efficiently discharged by the suction force applied to the liquid residual amount detection device 11, and the ink can be more stably charged with a high deaeration degree.

Figure 5:
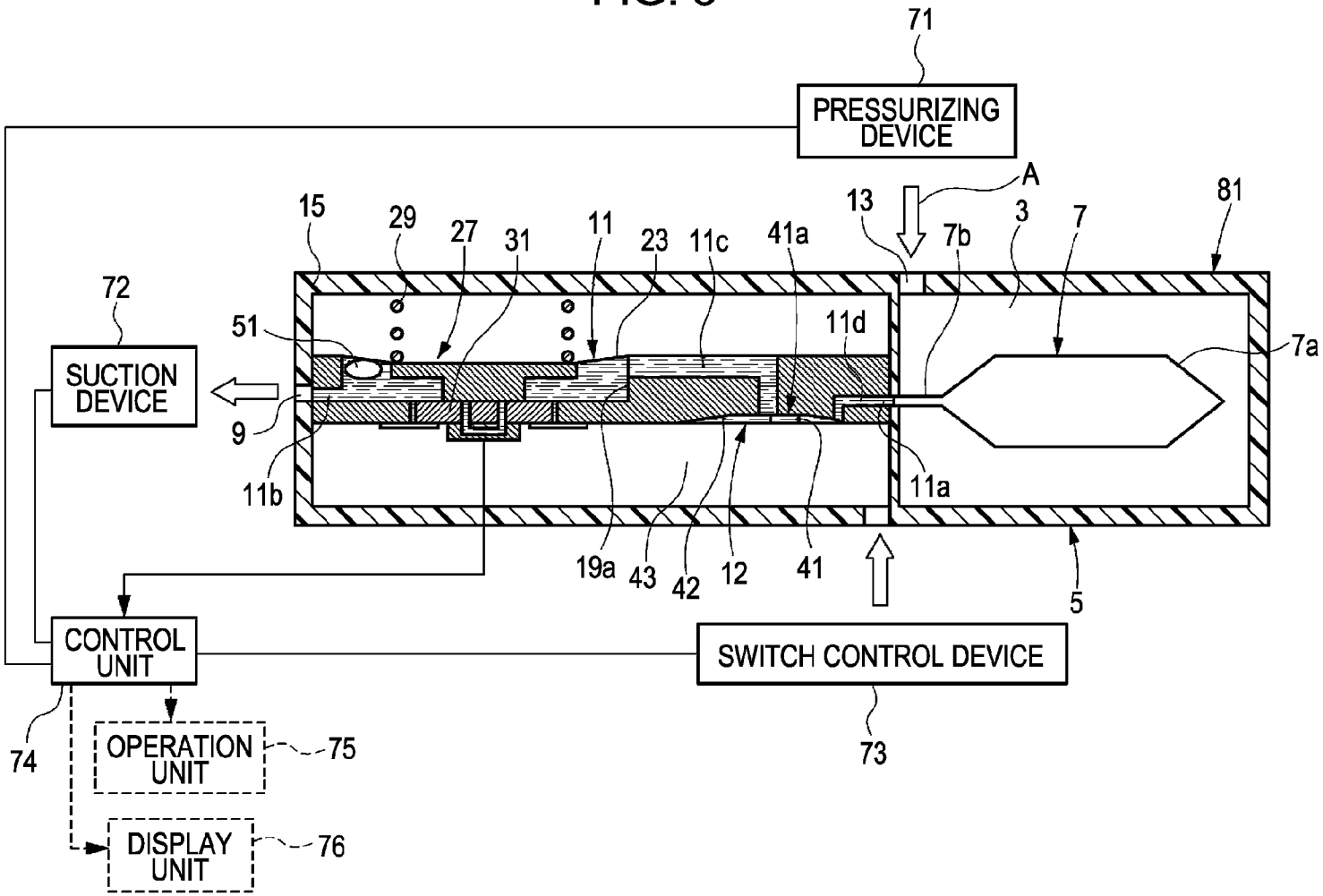
FIG. 5 is a vertical cross-sectional view showing a first injecting process of the ink cartridge as a liquid vessel according to a second embodiment of the invention.
Figure 6:
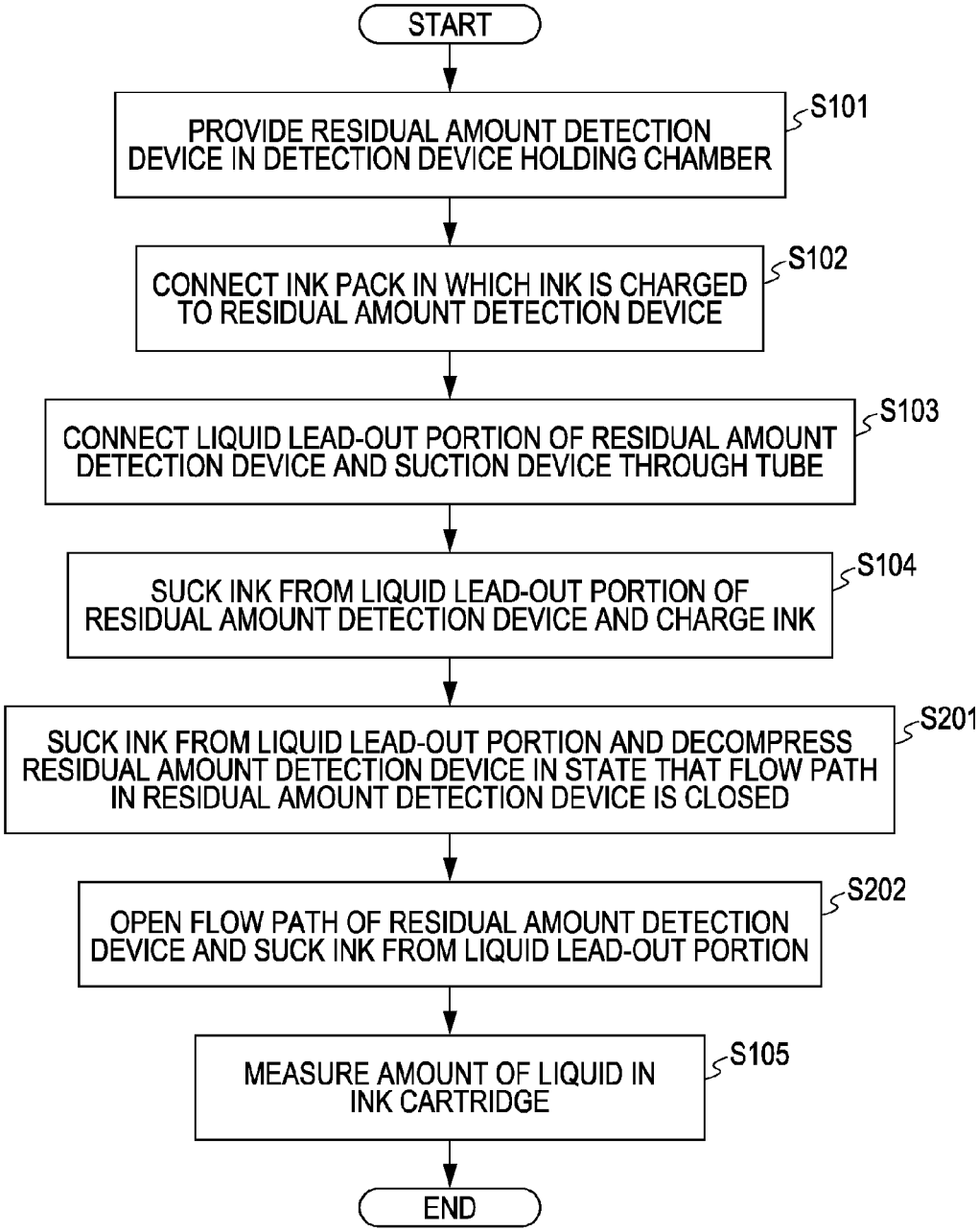
FIG. 6 is a flowchart showing a method of manufacturing the liquid vessel according to the second embodiment of the invention.
Figure 7:
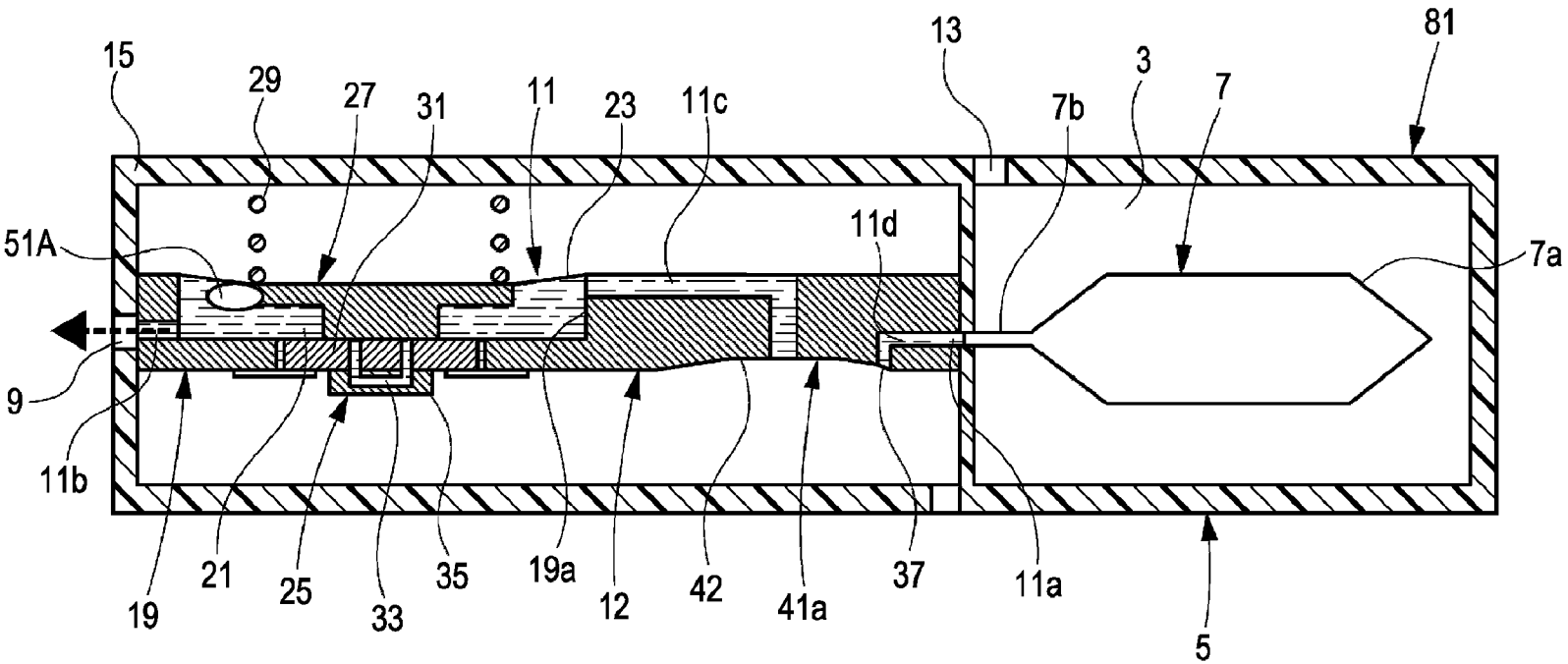
FIG. 7 is a vertical cross-sectional view showing a decompressing process after injecting the ink into the ink cartridge as the liquid vessel according to the second embodiment of the invention.
Figure 8:
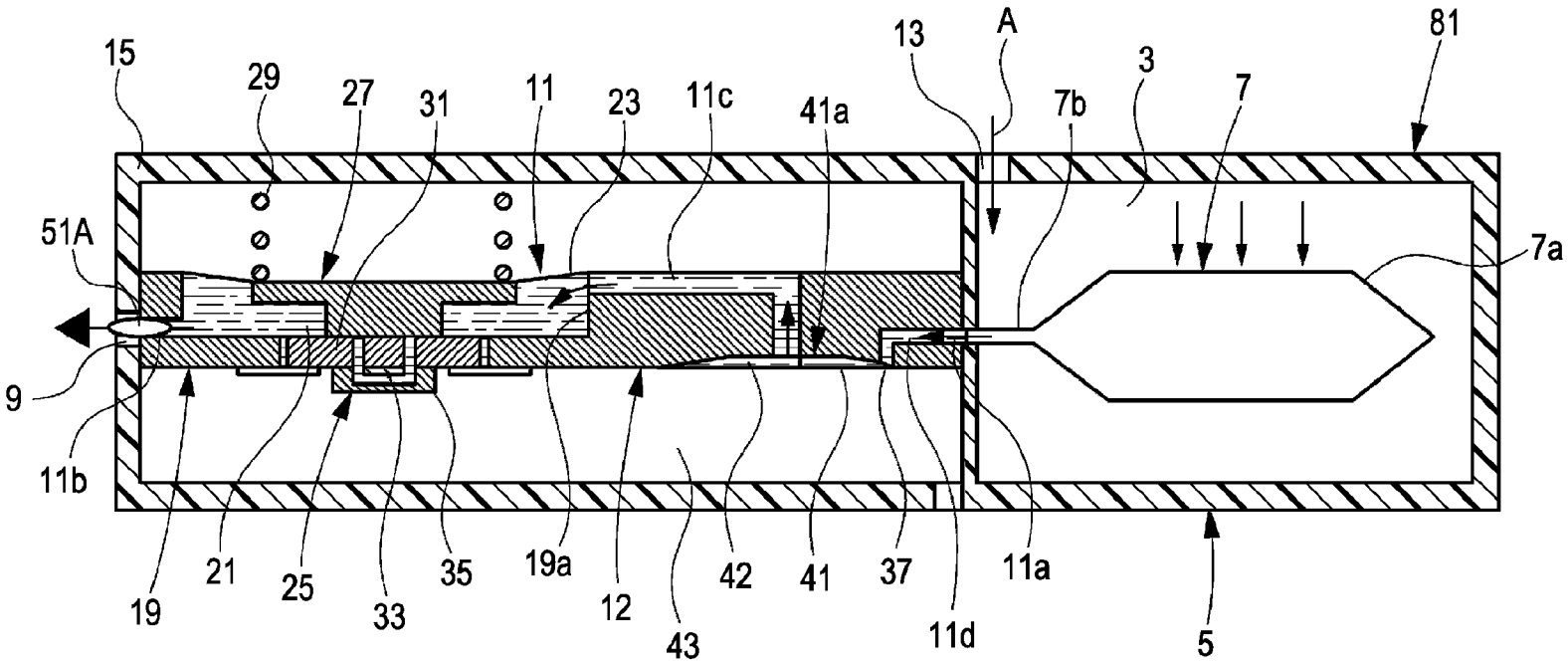
FIG. 8 is a vertical cross-sectional view showing a second injecting process of the ink cartridge as the liquid vessel according to a second embodiment of the invention.

FIG. 5 is a vertical cross-sectional view showing a first injecting process of injecting the ink from the liquid containing body 7 into the liquid residual amount detection device 11 in the liquid vessel depicted as an ink cartridge 81, according to a second embodiment of the invention. FIG. 6 is a flowchart showing a method of manufacturing the liquid vessel according to the second embodiment of the invention. FIG. 7 is a vertical cross-sectional view showing a decompressing process after injecting the ink into the ink cartridge according to the second embodiment of the invention. FIG. 8 is a vertical cross-sectional view showing a second injecting process of the ink cartridge, according to a second embodiment of the invention. In the present embodiment, the same portions as the ink cartridge described in the first embodiment are denoted by like reference numerals and the description thereof will be omitted.

In the ink cartridge 81 shown in FIG. 5, the liquid residual amount detection device 11 is more improved compared with the ink cartridge 1 described in the first embodiment.

The liquid residual amount detection device 11 is improved in that a flow path opening/closing device 12 is provided between the liquid inflow port 11*a* connected with the discharge port 7*b* of the liquid containing body 7 and the liquid detection chamber 21.

The flow path opening/closing device 12 includes a concave portion 41 having a recessed curvature 41*a* formed in a flow path 11*c* that communicates with the liquid detection chamber 21. A flow path 11*d* communicates with the liquid inflow port 11*a*; a flexible valve 42 covering the opened surface of the concave portion 41; a pressurization chamber 43 formed at the outer surface side of the valve 42; and a switch control device 73 for switching the pressurization chamber 43 to a predetermined pressurization state or an atmosphere open state, controlling the operation of the valve 42.

The switch control device 73 supplies pressurization air into the pressurization chamber 43 to closely attach the valve to the recessed curvature 41*a*, as shown in FIG. 7, such that the flow path 11*c* and the flow path 11*d* are disconnected from each other. Accordingly, the liquid residual amount detection device 11 and the liquid containing body 7 are disconnected from each other in an air-tight manner. The switch control device 73 releases the atmosphere from the pressurization chamber 43 to separate the valve 42 from the recessed curvature 41*a*, as shown in FIGS. 5 and 8, such that the flow path 11*c* and the flow path 11*d* communicate with each other. Accordingly, the liquid residual amount detection device 11 and the liquid containing body 7 communicate with each other.

The suction device 72, which is connected to the liquid lead-out portion 9 to apply a negative pressure to the liquid residual amount detection device 11; the pressurizing device 7, for supplying pressurization air to the pressurization chamber 3 and pressurizing the liquid containing body 7; and the switch control device 73 are controlled by an ink charge control unit 74. The operation controlled by the control unit 74 may be instructed through an operation unit 75 and control operation contents can be checked by a display unit 76; for example, a cathode ray tube (CRT) or a liquid crystal display device.

Next, an ink charging method for obtaining an initial charging state, in which the ink is charged into the liquid residual amount detection device 11 of the ink cartridge 81, will be described with reference to FIG. 6.

The ink charging method according to the second embodiment of the invention further includes two steps S201 and S202 between the step S104 and the step S105 of the ink charging method described in the first embodiment.

The step S104 is a first injecting process of setting the flow path between the liquid containing body 7 and the liquid residual amount detection device 11 to a communication state by the flow path opening/closing device 12; supplying pressurization air to the pressurization chamber 3 by the pressurizing device 71; performing suction by the suction device 72; and injecting the ink 6 from the liquid containing body 7 into the liquid residual amount detection device 11. In this way, air remaining in the liquid inflow port 11*a*, the liquid detection chamber 21, and the liquid outflow port 11*b*, all of which are the flow path from the discharge port 7*b* to the liquid lead-out port 9, and the ink 6, is injected into the flow paths.

The subsequent step S201 is a decompressing process of closing the flow paths 11*c* and 11*d* between the liquid containing body 7 and the liquid residual amount detection device 11 by the flow path opening/closing device 12, and starting a suction operation of the liquid residual amount detection device 11, into which the ink is injected, by the suction device 72, as well as decompressing the liquid residual amount detection device 11.

The subsequent step S202 is a second injecting process of returning the flow paths 11*c* and 11*d* between the liquid containing body 7 and the liquid residual amount detection device 11 to the communication state by the flow path opening/closing device 12; starting the suction operation of the liquid residual amount detection device 11 by the suction device 72; and a pressurization operation of the pressurization chamber 3 by the pressurizing device 71. Then, liquid is injected from the liquid containing body 7 into the decompressed liquid residual amount detection device 11 again.

When the first injecting process is performed in the step S104, as shown in FIG. 5, a small amount of air bubbles 51 may remain in the liquid detection chamber 21 in the liquid residual amount detection device 11.

However, when the decompressing process is performed in the step S201, the air bubbles 51 remaining in the liquid detection chamber 21 expand by the depression of the liquid detection chamber 21 to grow to large air bubbles 51A, as shown in FIG. 7.

Then, when the second injecting process is performed in the step S202, the large air bubbles 51A which remain in the liquid detection chamber 21 are easily discharged through the liquid lead-out portion 9. That is, the large air bubbles 51A are rapidly discharged through the liquid lead-out portion 9 as shown in FIG. 8. As a result, the ink 6 is charged into the liquid residual amount detection device 11 with a high deaeration state.

In the ink charging method according to the second embodiment, if the first injecting process (step S104), decompressing process (step S201), and second injecting process (step S202) are included, small air bubbles 51 remaining in the liquid residual amount detection device 11 after the first injecting process expand by the decompressing process and grow to the large air bubbles 51A, which can be easily discharged, as shown in FIG. 7. The grown air bubbles 51A can be discharged from the liquid lead-out portion to the outside of the liquid residual amount detection device 11 by the second injecting process such that a higher deaeration degree can be obtained.

In the present embodiment, the step S201 of decompressing the flow paths 11*c* and 11*d* of the liquid residual amount detection device 11 is performed by applying a negative pressure from the liquid lead-out portion 9 to the liquid residual amount detection device 11 by the suction device 72 in a state in which the flow patch opening/closing device 12 provided in the flow paths between the liquid residual amount detection device 11 and the liquid containing body 7 is closed. Accordingly, it is possible to efficiently decompress only the flow paths 11*c* and 11*d* of the liquid residual amount detection device 11 with certainty and to easily apply a pressure difference to the injection of the ink from the liquid containing body 7 into the liquid residual amount detection device 11.

In the present embodiment, the step S104 or step S202 of injecting the ink 6 from the liquid containing body 7 into the liquid residual amount detection device 11 is performed by applying a negative pressure from the liquid lead-out portion 9 to the liquid residual amount detection device 11 in a state in which the flow patch opening/closing device 12 provided in the flow paths 11*c* and 11*d* between the liquid residual amount detection device 11 and the liquid containing body 7 is opened. Accordingly, it is possible to actively inject the ink from the liquid containing body 7 to the liquid residual amount detection device 11 through the flow path opening/closing device 12 by the suction force due to the negative pressure applied to the liquid residual amount detection device 11 and to prevent external air from being mixed into the liquid residual amount detection device 11. Thus, it is possible to charge the ink in a stable deaeration state.

In the above-described ink charging method, it is preferable that the process of decompressing the flow path of the liquid residual amount detection device 11 in advance is included before the step S104 of injecting the ink 6 in the liquid containing body 7 into the liquid residual amount detection device 11.

By this configuration, the liquid in the liquid containing body 7 is easily injected into the liquid residual amount detection device 11 by the pressure difference between the liquid containing body 7 and the liquid residual amount detection device 11. Accordingly, a charging time can be reduced and thus the productivity can be improved.

In the above-described ink charging method, it is preferable that the ink 6 in the liquid containing body 7 is charged into the liquid residual amount detection device 11 and the ink is then discharged through the liquid lead-out portion by the suction of the suction device 72 until the amount of ink stored in the ink cartridges 1 and 81 becomes a predetermined amount.

By this configuration, since the amount (initial charge amount) of ink remaining in the ink cartridge 1 can be accurately set, it is possible to stably produce a reliable ink cartridge with a uniform ink storage amount.

In the above-described ink charging method, it is preferable that the temperature of the ink in the liquid containing body 7 is increased to a predetermined temperature when the ink in the liquid containing body 7 is injected into the liquid residual amount detection device 11.

When the viscosity of the ink in the liquid containing body 7 is reduced due to the increase of the temperature, the ink is easily injected from the liquid containing body 7 to the liquid residual amount detection device 11. For example, when the negative pressure is applied to the liquid residual amount detection device 11 in order to facilitate the injection of the ink into the liquid residual amount detection device 11, the negative pressure applied to the liquid residual amount detection device 11 can be reduced, and the burden on the sensor of the liquid residual amount detection device 11 can be reduced.

Although in the above-described embodiment the ink is fully stored in the liquid containing body 7 before the ink is injected into the liquid residual amount detection device 11, the ink may not be fully stored. For example, the liquid containing body may be filled with air and subsequently filled with ink during the course of use.

The liquid vessel in which the liquid is charged by the manufacturing method of the invention is not limited to the ink cartridge mounted in the inkjet recording apparatus. The liquid vessel may be used in a variety of liquid consuming apparatuses including a liquid ejecting head.

As examples of the liquid consuming apparatuses the liquid ejecting head, there are, for example, an apparatus including a color material ejecting head used for manufacturing a color filter of a liquid crystal display, an apparatus including an electrode material (conductive paste) ejecting head used for forming an electrode of an organic electroluminescence (EL) display or a surface light-emission display (FED), an apparatus including a bioorganic material ejecting head used for manufacturing a bio chip, an apparatus including a sample ejecting head as a precise pipette, and a printing apparatus or a micro dispenser.

While this invention has been described in conjunction with the specific embodiments thereof, it is evident that many alternatives, modifications, and variations will become apparent to those familiar with this field upon reading the description above. Accordingly, the preferred embodiments of the invention as set forth herein are intended to be illustrative, not limiting. Such alternatives, modifications, and variations are permissible without departing from the scope and spirit of the invention.

What is claimed is:

1. A method of manufacturing a liquid vessel including a liquid containing body storing liquid therein, and a liquid residual amount detection device for detecting a residual amount of liquid in the liquid containing body, the liquid residual amount detection device comprises a liquid inflow port adapted to be connected to a discharge port of the liquid containing body, a liquid lead-out portion configured to supply the liquid and a vibration detection portion configured to apply vibration to a flow path between the liquid inflow port and the liquid lead-out portion the method comprising:

connecting the liquid inflow port of the liquid residual amount detection device to the discharge port of the liquid containing body in which the liquid has been stored in advance; and injecting the liquid in the liquid containing body into the liquid residual amount detection device to obtain a state in which the flow path is charged with the liquid, thereby extruding gas remaining in the flow path through the liquid lead-out portion.

2. The method according to claim 1, wherein the liquid containing body is pressurized by a pressurizing device such that the liquid in the liquid containing body is injected into the liquid residual amount detection device.

3. The method according to claim 1, wherein the liquid in the liquid containing body is injected into the liquid residual amount detection device by suction of a suction device connected to the liquid lead-out portion.

4. The method according to claim 1, further comprising decompressing the flow path of the liquid residual amount detection device in advance before the liquid in the liquid containing body is injected into the liquid residual amount detection device.

5. The method according to claim 1, further comprising:

injecting the liquid in the liquid containing body into the liquid residual amount detection device;

decompressing the liquid residual amount detection device into which the liquid is injected; and injecting the liquid in the liquid containing body into the decompressed liquid residual amount detection device again.

6. The method according to claim 5, wherein the decompressing of the liquid residual amount detection device is performed by applying a negative pressure from the liquid lead-out portion to the liquid residual amount detection device when a flow path opening/closing device provided in the vicinity of the liquid inflow port of the liquid residual amount detection device is closed.

7. The method according to claim 5, wherein the injecting of the liquid in the liquid containing body into the decompressed liquid residual amount detection device again is performed by applying a negative pressure from the liquid lead-out portion to the liquid residual amount detection device when a flow path opening/closing device provided in the vicinity of the liquid inflow port of the liquid residual amount detection device is opened.

8. The method according to claim 1, wherein the liquid in the liquid containing body is charged into the liquid residual amount detection device and the liquid is then discharged from the liquid lead-out portion until the amount of liquid stored in the liquid containing body becomes a predetermined amount.

9. The method according to claim 1, wherein the liquid is ink supplied to an inkjet recording apparatus, and the ink in the liquid containing body is injected into the liquid residual amount detection device in a state in which a temperature of the ink in the liquid containing body is increased to a predetermined temperature.

10. The method according to claim 1, wherein the liquid vessel is an ink cartridge configured to be detachably mounted into a cartridge mounting portion of an ink jet recording apparatus after the liquid vessel is manufactured.

11. The method according to claim 1, wherein the liquid residual amount detecting device is connected to a detection device holding chamber of the liquid vessel.

* * * * *